United States Patent [19]

Antonious

[11] Patent Number: 4,828,265

[45] Date of Patent: May 9, 1989

[54] GOLF CLUB HEAD

[76] Inventor: Anthony J. Antonious, 205 E. Joppa Rd., Towson, Md. 21204

[21] Appl. No.: 603,250

[22] Filed: Apr. 23, 1984

Related U.S. Application Data

[63] Continuation-in-part of Ser. No. 244,692, Mar. 17, 1981, abandoned, which is a continuation-in-part of Ser. No. 1,736, Jan. 8, 1979, abandoned.

[51] Int. Cl.[4] ..... A63B 53/04

[52] U.S. Cl. ..... 273/167 E; 273/175; 273/169

[58] Field of Search ..... 273/167 E, 164, 193 R, 273/174

[56] References Cited

U.S. PATENT DOCUMENTS

| | | | |
|---|---|---|---|
| D. 192,515 | 4/1962 | Henrich | 273/167 E |
| 780,776 | 1/1905 | Brown | 273/167 E |
| 1,913,821 | 6/1933 | Stumpf | 273/167 E |
| 2,003,951 | 6/1935 | Pepin | 273/164 |
| 2,041,676 | 5/1936 | Gallagher | 273/167 E |
| 2,550,846 | 5/1951 | Milligan | 273/167 E |
| 3,035,839 | 5/1962 | Coglianese | 273/164 |
| 3,162,206 | 3/1964 | Sabia | 273/193 R |
| 3,430,963 | 3/1969 | Wozniak et al. | 273/164 |
| 3,468,544 | 9/1969 | Antonious | 273/167 E |
| 3,997,170 | 12/1976 | Goldberg | 273/167 E |
| 4,065,133 | 12/1977 | Gordos | 273/167 E |

FOREIGN PATENT DOCUMENTS

| | | | |
|---|---|---|---|
| 150528 | 3/1953 | Australia | 273/167 E |
| 538 | 1/1977 | Japan | 273/167 E |
| 340579 | 1/1931 | United Kingdom | 273/174 |

*Primary Examiner*—George L. Marlo

*Attorney, Agent, or Firm*—Finnegan, Henderson, Farabow, Garrett & Dunner

[57] ABSTRACT

A wood-type golf club having a deep, channel-shaped cavity formed in the top surface of the club extending rearwardly from the ball striking face. The ball striking face has a height which is at least 50% of the distance between the top surface and the bottom surface of the club head. The depth of the cavity is at least ¼ inch from the top surface of the club head the width of the cavity is at least ½ inch. The cavity preferably is further characterized as having an aspect ratio, defined as the square of the width at a transverse cross section of the cavity divided by the area of that transverse cross section, of less than 20. The cavity preferably has an average transverse gradient, defined as an angle between a line from the bottom low point of the cavity at a transverse cross section of the cavity to the cavity edge and a line across the top of the cavity at that cross section, greater than 3 degrees along the cavity's length.

48 Claims, 4 Drawing Sheets

FIG. 1.
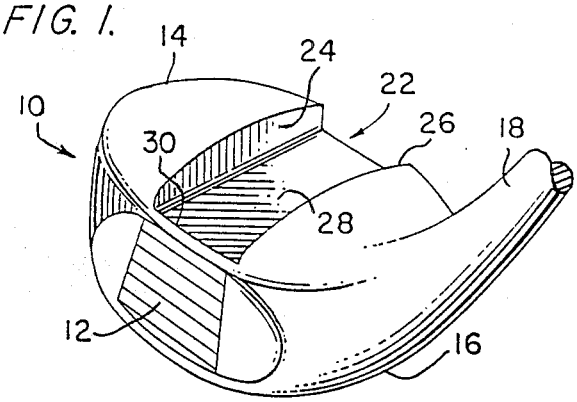
FIG. 11.
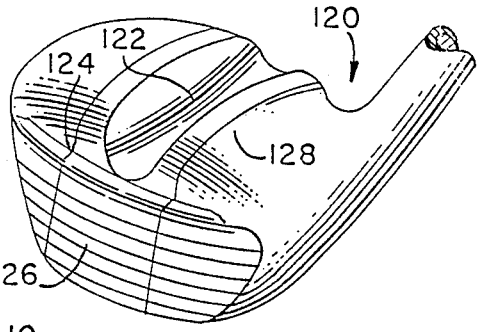
FIG. 2.
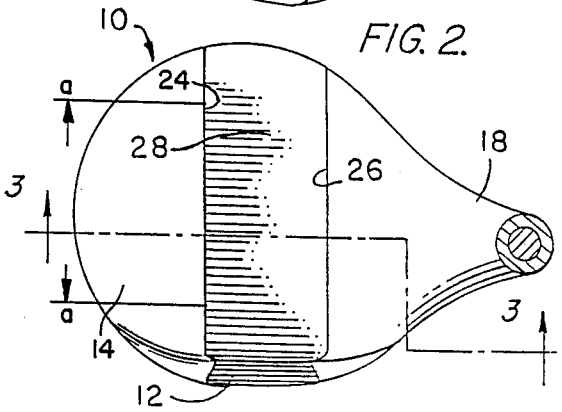
FIG. 3.
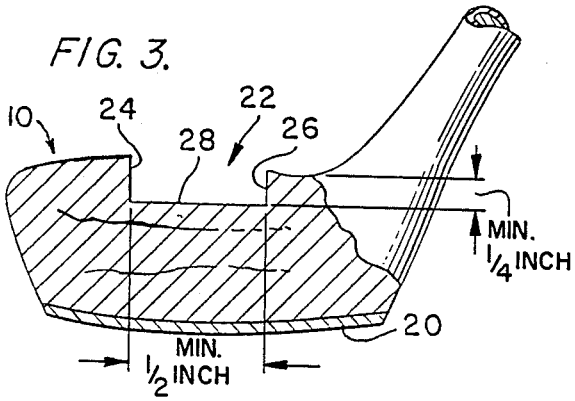
FIG. 6.
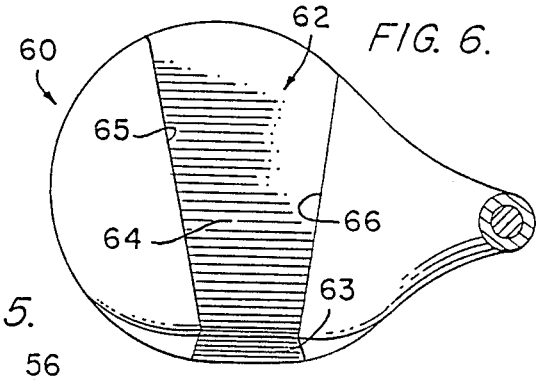
FIG. 7.
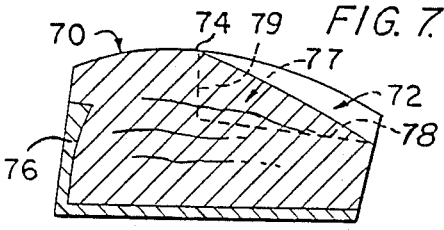
FIG. 5.
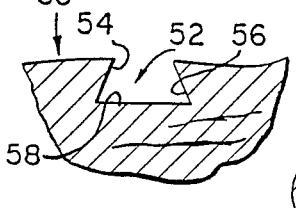
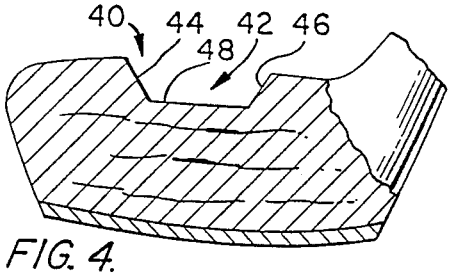
FIG. 4.
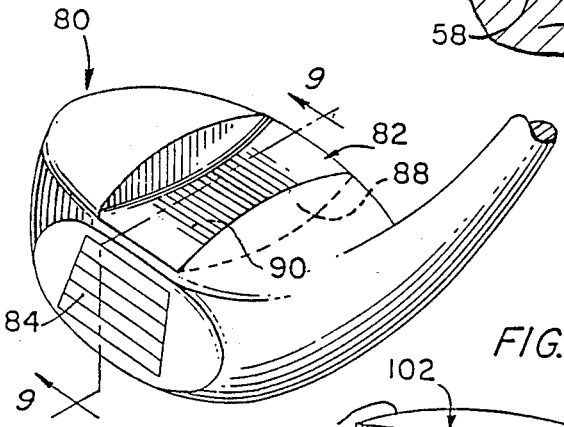
FIG. 8.
FIG. 10.
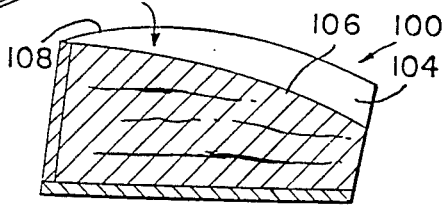
FIG. 9.
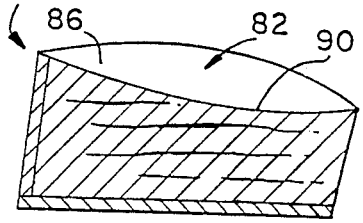

GOLF CLUB HEAD

BACKGROUND OF THE INVENTION

1. Field of the Invention

This application is a continuation-in-part application of application Ser. No. 244,692, filed on Mar. 17, 1981, which in turn is a continuation-in-part of application Ser. No. 1,736 filed Jan. 8, 1979, both applications now being abandoned.

This invention relates to golf clubs and, more particularly, to wood-type golf club heads having aerodynamic designs to reduce drag, increase club head lift, and stabilize the club head during its swing and specifically at impact.

2. Discussion of the Prior Art

In playing golf, wood-type golf clubs are used for hitting a golf ball a longer distance. Normally, a wood driver is used for the first shot of a given hole to obtain maximum distance from the tee. However, other woods, known as fairway woods, are used for subsequent shots that reguire the ball to travel long distances toward or onto the putting green. The force with which a golf ball is struck depends upon the mass of the club head and the club head acceleration at the moment of impact with the ball in accordance with well known laws of physics. Clubs are made with various swing weights to achieve optimum speed and control by a particular player using a club.

Modern technological developments have provided improved golf club shafts of lighter weight material so that the club head can be swung with greater speed and acceleration while maintaining the weight of the club head to impart maximum force upon the ball. The typical wood type golf club has a broad face and an asymmetric shape which does not provide the best configuration from the standpoint of aerodynamic drag.

Some efforts have been made to increase club head speed by reducing aerodynamic drag as shown in my prior U.S. Pat. No. 3,468,544. Another patent of interest is U.S. Pat. No. 2,550,846 to Milligan which shows a golf club having a shallow recess in the top surface in the form of a shallow streamlined groove which is claimed to impart spin to a ball as it is struck. Another prior patent to Gordos (U.S. Pat. No. 4,065,133) shows a golf club having a plurality of spaced grooves which are deep, but the depth is at least as great as the width and the individual grooves are relatively small and narrow compared to the overall size of the club head. The patent to Goldberg (U.S. Pat. No. 3,997,170) shows a golf club having a plurality of parallel grooves which are also relatively shallow and small with respect to the overall club head size. Still another prior art patent to Cullenizi (U.S. Pat. No. 3,035,839) shows a golf club having a sighting alignment slot in the top of a club which is relatively narrow with respect to the overall club head size.

The above designs do not significantly reduce drag or increase club head speed and lift, as does the present invention. Some of the designs are also aesthetically unpleasing or do not conform to the Rules of Golf defining the structure of a golf club as established by the U.S. Golf Association.

SUMMARY OF THE INVENTION

The present invention is directed to a golf club structure which achieves increased club head speed when it is swung without the need for changing the overall length, weight or other major characteristics of the club. This is accomplished by reducing the aerodynamic drag on the club head as it is swung, thus enabling a player using the club to hit a ball further without exerting additional force during a swing. The arrangement also provides aerodynamic stability which permits increased awareness and control of the club head position, thereby producing a more consistent swing and greater accuracy. In addition, the invention increases the aerodynamic lift on the club head, thereby making the club head swing and feel lighter. The sum of the effects provided by the invention is to provide the user with increased distance and more directed flight of the golf ball.

The golf club of the present invention is provided with a deep cavity in the top surface of the club head extending rearwardly from the ball striking face. Air flowing through the cavity across the top of the club head as it is swung alters what conventionally is a region of low pressure behind the club head to a higher pressure. This increase in pressure at the rear of the club counteracts the even higher aerodynamic pressure on the face of the club and decreases the aerodynamic drag on the club. The shape and size of the cavity which produces the improved results is characterized by a number of parameters including width and depth, aspect ratio and average transverse gradient. The aspect ratio is a recognized aerodynamic parameter and is defined as the square of the width between the top edges of the cavity at a transverse cross section of the cavity divided by the cross sectional area at that transverse cross section.

The transverse gradient is another aerodynamic parameter and is defined as the angle between a first line from the bottom low point of a cavity at a transverse cross section of the cavity to the highest edge of the cavity and a second line across the highest point at the top edge of the cavity such that the second line forms a right angle with a vertical line through the bottom of the cavity at the deepest point. The bottom low point is further defined as the lowermost portion of the cavity at a given transverse cross section of the cavity. When the cavity has a symmetrical configuration, the bottom low point would be equidistant from the edges of the cavity or along the longitudinal center line of the cavity. When the cavity is asymmetrical, the bottom low point does not coincide with and would be spaced from the longitudinal center line of the cavity. For asymmetrical cavities, there will be two separate and different transverse gradient angles, one for each edge. When the cavity is asymmetrical, the transverse gradient is measured from the deepest or lowest part of the cavity below the top surface of the club head. For such cavities, some aspects of the aerodynamic characteristics of the cavity can be characterized by an average transverse gradient at a given cross section which is calculated by adding both transverse gradient angles and dividing by two.

Optimum results are produced with a cavity wherein: the depth of the cavity is equal or greater than $\frac{1}{4}$ inch below the top surface of the club head and the width of the cavity is at least $\frac{1}{2}$ inch wide and is substantially greater than the depth, the aspect ratio of the cavity is less than 20 and the average transverse gradient of the cavity is greater than 3 degrees.

When the club head with the present invention is swung at high velocities, the cavity achieves a significant channeling and retention of higher energy air into the club head wake at the rear of the club. The walls of the cavity provide sufficient depth to contain and direct a jet-type air flow immediately at the back of the club head. The upper, elongated edges of the cavity provide a stabilizing effect on the air flow since they define a flow line that is independent of the club head speed and therefore function in a consistent manner throughout a golfer's swing from start to maximum speed when the ball is struck. These edges assist in maintaining the air flow patterns independent of the aerodynamic Reynold's number. The front edge of the cavity at the club head face should be designed to eliminate or minimize turbulent air flow and achieve as laminar an air flow pattern as possible at this introduction point, and the cavity along its length must be streamlined to channel and retain the high velocity laminar air flow throughout the length of the club. A cavity having these characteristics provides an increased flow of high energy air into the club head wake which produces a higher pressure at the rear of the club head than exists in regular clubs not having the present invention. The cavity has a pronounced effect on reducing drag, thereby allowing higher club head speeds and a larger energy transfer to golf balls being struck.

A cavity with the above characteristics provides significant improvements over the prior art clubs. Such a cavity may be symmetrical or asymmetrical at its transverse cross sections, and may have various shapes such as rectangular (where the bottom and sides meet at a 90° angle), rounded, or a variety of other cross sectional configurations which meet the above parameters.

Accordingly, it is a primary object of the present invention to overcome the above mentioned disadvantages of the prior art by aerodynamically designing a club head to substantially reduce drag, minimize turbulent air flow and improve swing stability while being aesthetically pleasing and conforming to the established U.S.G.A. Rules of Golf.

A further object of the present invention is to provide a golf club head which increases club head lift as the club head is swung, thereby reducing the apparent swing weight of the club head and enabling additional acceleration for a given force resulting in a higher club head speed at impact with the golf ball.

Another object of the present invention is to provide a golf club head that provides greater aerodynamic stability and increased awareness of the club face position, thereby producing greater control of the club as it is swung to produce a more consistent swing and greater accuracy.

Yet another object of the present invention is to provide a golf club head which at the bottom of the swing plane is induced to stay close to the ground for a longer and flatter swing plane than conventional clubs. This effect is created by the improved aerodynamics of the cavity when in the vicinity of the ground.

Other objectives and advantages of the present invention will become apparent from the following description of the preferred embodiments taken in conjunction with the accompanying drawings. The objectives and advantages of the invention will be realized and attained by means of the elements, limitations and combinations particularly pointed out in the appended claims.

To achieve the objectives and in accordance with the purpose of the invention, as embodied and broadly described herein, the invention comprises a club head for a wood-type golf club to be swung at high velocities, the club head having a ball striking face, a rear face, a heel, a toe, a top surface and a bottom, the ball striking face being made to strike a golf ball and having a height (h shown in FIG. 1) which is at least 50% of the distance (H shown in FIG. 3) between the top surface and the bottom surface of the club head. The golf club head includes aerodynamic means for (1) raising the pressure at the rear of the club head and thus reducing the aerodynamic drag on the club head to provide greater acceleration for increased club head speed, (2) increasing the aerodynamic lift on the club head to provide a lighter swing feel, and (3) stabilizing the club head both during its swing and at impact to facilitate a repetitive optimum club face position, thus providing improved directional control of the resultant golf shot. The aerodynamic means includes an elongated, deep and streamlined cavity having side walls and a bottom surface which form an air channel of sufficient depth and width to channel, retain and exhaust a high energy flow of air directly behind the club head into the club head near wake, the cavity being located in the top surface of the club head and extending substantially perpendicular to and rearwardly from the ball striking face to the rear face and forming two elongated top edges at the juncture with the top surface of the club head. The edges provide a stabilizing effect on the flow of high speed air by defining flow lines independent of club head speed. The cavity has a depth of at least ¼ inch and a width which is at least ½ inch along a substantial portion of its length. Generally, the cavity should have an average aspect ratio which is less than 20, and more preferably less than 8, along a substantial portion of its length. The flow of air through the cavity, when the club head is swung at high velocities, raises the pressure at the rear of the club head and acts as a vertical stabilizer which helps to maintain alignment of the club head on its swing path.

It is to be understood that the foregoing general description and the following detailed description are exemplary and explanatory only and are not restrictive of the invention, as claimed.

The accompanying drawings, which are incorporated in and constitute a part of this specification, illustrate several embodiments of the invention and, together with the description, serve to explain the principles of the invention.

BRIEF DESCRIPTION OF THE DRAWINGS

FIG. 1 is a perspective view of a golf club head of the present invention.

FIG. 2 is a top plan view of the club head of FIG. 1.

FIG. 3 is a sectional view of the club head of FIG. 2 taken along lines 3—3 of FIG. 2.

FIG. 4 is a side sectional view of a second embodiment of the golf club of the present invention.

FIG. 5 is a partial side sectional view of a third embodiment of the golf club head of the present invention.

FIG. 6 is a top view of a fourth embodiment of the club head of the present invention.

FIG. 7 is a sectional view of a fifth embodiment of the club head of the present invention.

FIG. 8 is a perspective view of a sixth embodiment of the club head of the present invention.

FIG. 9 is a sectional view taken along lines 9—9 of FIG. 8.

FIG. 10 is a side sectional view of a seventh embodiment of the club head of the present invention.

FIG. 11 is a perspective view of an eighth embodiment of the club head of the present invention.

DESCRIPTION OF THE PREFERRED EMBODIMENT

Figure 12:
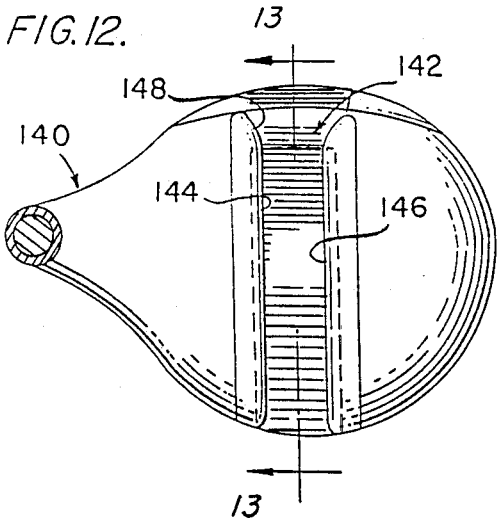
FIG. 12 is a top view of a ninth embodiment of the club head of the present invention.

Reference is now made in detail to the present preferred embodiments of the invention, examples of which are illustrated in the accompanying drawings.

The golf club of the present invention is provided with an improved aerodynamic shape to substantially alter the air flow pattern moving across the top of the club head. The aerodynamic shape causes a reduction in drag, a reduction in turbulent air flow and an increase in lift for considerable improvement in the stability of the club head resulting in increased speed, a lighter feel and better control when a golf club is swung at high velocities.

As is shown, for example, in FIG. 1, the top of the club head 10 is provided with a deep cavity 22 across the top surface of the club head extending substantially perpendicular to and rearwardly from the ball striking face 12. Various designs in the cross sectional shape may be used in keeping within the scope of the present invention as long as certain aerodynamic design parameters are achieved and the depth and width of the cavity are significant with respect to the overall club head dimensions.

To be effective, the cavity must achieve a significant channeling and retention of higher energy air into the club head wake at the rear of the club. The walls of the cavity must provide sufficient depth to contain and direct a jet-type air flow immediately at the back of the club head when the club head is swung. The cavity should form upper, elongated longitudinal edges at the top surface of the club head to provide a stabilizing effect on the flow of high velocity air. These longitudinal edges define continuous flow lines that are independent of the club head speed and therefore function in a consistent manner through a golfer's swing from start to maximum speed when the ball is struck. These flow lines assist in the retention and channeling of air.

The transverse horizontal front edge 30 of the cavity at the club head face should preferably be designed to minimize turbulent air flow in order to achieve as laminar a flow pattern as possible at this introduction point of the air flow to the cavity. In addition, it is preferable that the front vertical edges of the channel be rounded to effect the optimum ducting and transition of air flow from the front of the club head into the channel. The design of this invention provides a smooth transition of air flow, minimizes the separation of air away from the cavity and promotes the channeling of high velocity laminar air flow through the cavity. The cavity should be streamlined along its length to channel and retain the laminar air flow throughout the length of the club head, from the striking face 12 to the rear face.

It has been found that the cross sectional shape of the cavity having these aerodynamic qualities may be rounded, rectangular or have other irregular shapes. Various parameters are used to describe the dimensions and configuration of the cavity including the width and depth of the cavity with respect to the overall dimensions of the golf club head, the width of the cavity with respect to the depth of the cavity, the aspect ratio of the cavity, and the transverse gradient angle. The values of these parameters which assist in defining the present invention are set forth in detail in this specification.

When a golf club head is made in accordance with the invention, the high energy air flow through the cavity causes a reduction of the aerodynamic drag force acting on the club head in the following manner. The air that is impinged on the ball striking face generally creates a high pressure in this region, and as the air stream flows around the club head, it separates from the club head forming a low pressure region in the rear wake area located directly behind the club head. The differential between the high pressure region at the front of the club and the low pressure region behind the club causes an aerodynamic drag. In the present invention, the air flow through the cavity exhausts directly behind the club head into the low pressure area to raise the pressure at the rear of the club head and thus reduces the aerodynamic drag. The higher the pressure is raised at this rear point by the present invention, the greater the reduction in drag which enables the club head to be swung faster and more easily.

The force Fg required of a golfer to swing a golf club head can be written as the following equation:

$$Fg = \frac{W_c V_c^2}{2_g S} + D_c$$

where $W_c$ is the weight of the club head, $V_c$ is the club head velocity at impact with the golf ball, S is the distance of the club head travel, g is the acceleration of gravity and $D_c$ is the aerodynamic drag on the club head. Rewriting equation (1) as:

$$V_c = \sqrt{\frac{2_g S}{W_c}(F_g - D_c)}$$

illustrates that for a fixed force by the golfer Fg, the reduction of drag $D_c$ will result in increased club head speed $V_c$ at impact with the ball.

The air channeled through the upper cavity accelerates and travels at a higher velocity than the air traveling past the bottom of the club head. This higher velocity air creates a lower pressure level across the top of the club head than the pressure level across the bottom of the club head and therefore in effect creates a lift which reduces the apparent weight of the club.

In addition, the air channeled through the opening provides improved directional control during the swing by acting as a vertical stabilizer, analogous to the rudder on an aircraft or feathers on an arrow shaft, maintaining improved alignment of the club head in its swing path. This stabilizing effect allows a golfer to maintain better and more repetitive control of the club throughout the swing, enhancing consistency and the likelihood of squarely striking the golf ball.

The channeling of air through the cavity during the bottom of the swing of the club head tends to force the club head downwardly and more parallel to the ground for a longer distance than conventional clubs and also tends to keep the flight path of the club head on the optimum plane with respect to the intended flight path of the ball to be struck. A low and relatively straight path of the club head at the bottom of the swing is the most optimum swing path, and the channeling of air through the cavity promotes such a swing path. This channeling of air through the cavity produces a more optimum impact with the golf ball to permit a better momentum transfer, enabling maximum distance to be derived from the force applied to the swing. In addition, the air channeled in the cavity minimizes torquing or twisting of the club head at impact.

As previously indicated, the results achieved by the present invention occur when the cavity is substantially deep and wide with respect to the overall club head dimensions. Since these are general terms, the dimensions of the cavity may be expressed in a number of ways using a number of different parameters.

One way to define the cavity is relative to the overall dimensions of a golf club. Most golf club drivers have a club head width of approximately three (3) to four (4) inches from the toe to the heel and have a club head height of approximately one (1) to two (2) inches from the top surface of the club to the club head sole plate. Most conventional driver club heads also have a club head length of approximately 2 to 3 inches from the face of the club head to the rear of the club head. Fairway woods, such as number 2, 3, 4 and 5 woods, are usually progressively smaller but are usually at least 2½ inches from toe to heel and 1 to 2 inches from the top surface of the club to the club head sole plate. The cavity of the present invention can be applied to all standard and non-standard sized wood-type club heads which are designed to strike a golf ball in order to propel the ball a long distance.

Driver club heads typically have a club head face with a height of 1 to 2 inches. Driver golf club heads made according to the present invention should have a club head face height (h shown in FIG. 1) of at least 1 inch, a club head air cavity depth (d shown in FIG. 3) of at leat ¼ inch, an air cavity width (2 shown in FIG. 3) of at least ½ inch, a club head width from toe to heel of at least 2 inches, and a club head length from face to rear of at least 2 inches. Preferably, the width w and the depth d of the cavity are in a range of from 50% to at least 12% of the toe to heel (w shown in FIG. 3) and top surface to sole plate (H shown in FIG. 3) dimensions, respectively.

In the preferred embodiments, the aspect ratio, which has been previously defined as the square of the width between the top edges of the cavity divided by the cross sectional area, should be less than 20, more preferably in the range of less than 8. It will be appreciated that the cross sectional areas of various cavity cross sectional configurations may be determined using standard mathematical formulas and calculations in order to determine the aspect ratio.

Figure 26:
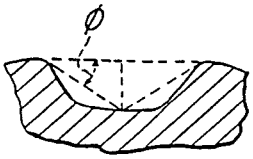
FIG. 26 is a partial cross sectional view of a golf club head of the present invention, when symmetrical.

Still another way of defining the aerodynamic traits of the cavity configuration is by way of the transverse gradient taken at the point of maximum depth along a longitudinal line on the bottom of the cavity. The transverse gradient has been previously defined as the angle between a line from the bottom low point of the cavity at a transverse cross section of the cavity to the highest edge of the cavity and a line across the highest points at the top edge of the cavity. FIG. 26 shows the angle as defined above as an angle $\phi$. In the preferred embodiments, the angle preferably should be greater than 31°, more preferably greater than 10°. This angle $\phi$ for a symmmetrical cavity may be determined precisely in degrees using the inverse tangent of the depth of the cavity divided by one-half of the width in accordance with the formula $$\phi = \mathrm{TAN}^{-1}\frac{D}{\frac{1}{2}W}$$

where D is depth and W is width of the cavity. This figure can then be looked up in a set of tangent tables to determine the exact angles. An average value of the two transverse gradient angles defined by an asymmetrical cavity can be used as an aerodynamic parameter to define the characteristics of such cavities. For example, the embodiment shown in FIG. 27 would have two transverse gradient angles $\phi$ and $\phi'$, and the average value of the transverse gradient would be calculated by adding the two values $\phi$ and $\phi'$ and dividing by two.

Through experimentation and application of the present invention, it has been found that to provide the desired results, the cavity of the present invention must have a depth of at least ¼ inch and a width of at least ½ inch, throughout a "substantial portion" of the cavity. In the preferred embodiments, the cavity also should have an aspect ratio of less than 20, more preferably less than 8, throughout a "substantial portion" of the cavity. Because no known formulas adequately define the characteristics of the present invention, it is difficult to define with mathematic precision just how much of the cavity's length must have the above characteristics in order to produce the beneficial results. Functionally, the "substantial portion" must be of sufficient length that the cavity will retain and channel the air flow and direct the air flow into the wake at the rear of the club head. From limited experimentation, it appears that to properly retain and channel air, the cavity must have the at least ¼ inch depth and at least ½ inch width at each transverse cross section along at least a ½ inch and preferably a 1 inch long section of the cavity. More preferably, the "substantial portion" should have a length which is at least half as long as the club head length from the face to the rear. The "substantial portion" could be at the front, middle, or rear of the cavity in the club head but should ultimately direct the high velocity flow of air into the wake of the club.

For example, a "substantial portion" of a cavity is illustrated as middle portion a-a shown in FIG. 2. The "substantial portion" shown in FIG. 2 is centered at the longitudinal midpoint of the cavity and has a length greater than ½ of the entire length of the club head. In each of the embodiments shown in FIGS. 1–30, the cavities have the desired aerodynamic characteristics along at least ½ inch of the middle portions of the respective cavities. It is preferred that the cavity have these characteristic's along the majority of the cavity's length. For example, in the embodiment shown in FIG. 1, the depth of the cavity is greater than ¼ inch, the width of the cavity is greater than ½ inch, and the aspect ratio is less than 8 at substantially every cross section along its path.

Unless a substantial portion of the cavity has the ¼ inch depth and ½ inch width limitations, the cavity will not sufficiently channel and retain an air flow that will reduce drag and provide the aerodynamic stabilizer which improves control. It is not, however, essential that the inlet and exhaust portions of the cavity meet these limitations to provide the desired effect. Similarly, it is not essential that the cavity be ¼ inch deep immediately at the inlet or the exhaust. For example, the cavity shown in FIG. 1 does not have an aspect ratio of less than 8 or a depth of ¼ inch at the face of the golf club. Instead, the cavity gradually increases in depth from the inlet portion to smooth the transition of air flow.

To achieve the desired channeling effect, the cavity also must include upper, elongated, longitudinal edges which are continuous along the length of the cavity to provide a stabilizing effect on the air flow. In short, the transverse cross sectional area of the channel, defined by the walls and bottom of the channel, must be capable of channeling and retaining a high energy flow of air throughout the length of the channel. A cavity having these aerodynamic characteristics directs the retained high energy flow directly to the rear wake of the club head reducing drag and also provides a stabilizing effect.

The aerodynamic characteristics of a golf club and the cavity of the present invention are complex and are not sufficiently known to be capable of absolute precise definition. Experimentation and application of the invention have shown that at least the ¼ inch depth and at least ½ inch width limitations along a substantial portion of the cavity 8 are necessary to achieve the desired result. Cavities having these limitations as well as an aspect ratio of less than 20, and more preferably, less than 8, have proven to provided optimum performance. It appears that the depth of the cavity is a highly significant factor. For example, club heads having a shallow cavity with a depth of less than ¼ inch have not produced the improvements provided by the present invention. It is believed that such shallow recesses fail to channel and retain sufficient air and instead create air turbulence. On the other hand, it has been found that cavities having depths of approximately ½ and widths of ¾ inch to 1-3/16 inches provide considerably improved aerodynamic results over conventional clubs. It is believed that the increased depth of the cavity promotes the channeling and retention of air.

It is further believed that for cavities having channels of lesser depths, for example in the range of ¼ inch, it is important that the side walls of the cavity be sloped fairly steeply to better retain the flow of air. It appears that for cavities with greater depth, less inclined curved side walls can be utilized with no adverse effects. Thus, a channel design like that shown in FIG. 1 would be preferable for channels having a depth in the range of ¼ inch, while cavities having greater depths of ½ inch or more can be designed like that shown in FIG. 20.

In a preferred embodiment of the invention, the cavity would have a depth of at least ¼ inch along a substantial portion, a width of at least ¾ inch, an aspect ratio less than 6 along the majority of the length and an average transverse gradient of at least 10 degrees. A still more preferred embodiment of the invention would have a depth of at least ⅜ inch along the majority of its length, a width of at least 1 inch, an aspect ratio of less than 6 along the majority of its length and a transverse gradient of more than 12 degrees.

Having described in some detail the general aspects and parameters of the invention, the specification will now refer to and describe the specific embodiments shown in the drawings.

FIGS. 1, 2 and 3 illustrate perspective plan and front sectional views of a club head 10 of the present invention. The club head is conventional in overall design and includes a ball striking face 12, a toe 14, a heel 16, a hosel 18 and a sole plate 20. The top surface of the club face is made with a deep cavity in the form of a slot or channel having a generally planar bottom surface and walls perpendicular thereto forming a 90° angle. These steep sides assist in retaining and channeling the flow of high velocity air. The cavity extends rearwardly from the ball striking face 12 and slopes toward the rear surface creating varying depths from a point 30 just behind the ball striking face to a point at the rear of the club head 10. The cavity is in excess of ¼ inch at its deepest point between the top surface of the golf club and the sole plate 20, and preferably is in excess of ¼ inch along its length. FIG. 1 illustrates a cavity that is approximately ⅜ inch deep along theentire length.

The width of the cavity is substantially greater than the depth and is at least ½ inch wide, although in the embodiment shown in FIG. 1, it is shown to be approximately 1 inch. The drawing is approximately to scale and illustrates a club head having a width of approximately 3 inches from the toe to the heel. The aspect ratio is less than 8 along its length, and the average transverse gradient angle is in excess of 10°. More particularly the aspect ratio of the embodiment shown in FIG. 1 is less than 4 and the transverse gradient is in excess of 35°.

It will be appreciated that the particular dimensions of the depth and width of the cavity will vary somewhat with the size of the club head itself. These dimensions are not limited except as described herein.

FIG. 4 shows a second embodiment of a club head 40 of the present invention. The club head 40 is shown in section only and is similar to the club head shown in FIGS. 1 to 3. The club head 40 includes a cavity 42 having straight side walls 44 and 46 which are sloped outwardly with respect to the bottom 48 of the cavity 42.

FIG. 5 shows a third embodiment of a club head 50, in a fragmented section only which is similar to the club head 40 of FIG. 4 except that a channel 52 is formed of walls 54 and 56 which slope inwardly with respect to the bottom 58 of the cavity 52.

FIG. 6 illustrates a fourth embodiment of the club head 60 of the present invention. The club head 60 includes a cavity 62 formed behind the ball striking face 63 having a bottom 64 and side walls 65 and 66 which flare outwardly from the ball striking face 63 toward the rear of the club head whereby the cavity 62 takes a trapezoidal configuration so the exhaust area at the end of the channel is greater than the intake area. Tests of the invention have shown that increasing the area of the cavity from front to rear produces an increased laminar flow of high energy air into the near wake of the club head.

FIG. 7 shows a fifth embodiment of a club head 70 of the present invention. A cavity 72 is formed in the top of the club head which begins at a point 74 which is substantially behind the ball striking face 76. Alternately, as shown in the dotted lines, a cavity 77 may be formed so the bottom surface 78 is perpendicular to the ball striking face 76 by making a vertical cut 79 from the top of the club head to the bottom surface of the cavity 77.

FIGS. 8 and 9 illustrate a sixth embodiment of the club head 80 of the present invention. In this embodiment, a channel-shaped cavity 82 is formed perpendicular to the ball striking face 84 and includes parallel, vertical walls 86 and 88. The bottom surface 90 of the channel 82 is concave in design which causes high velocity air being ducted through the cavity 82 to ramp downwardly and then upwardly as it leaves the rear end of the cavity as the club head is swung.

FIG. 10 illustrates a seventh embodiment of the club head 100 of the present invention. In this embodiment, a channel-shaped cavity 102 is formed of parallel, vertical side walls 104 (only one shown). The bottom surface 106 of the cavity is convex in design providing a second aerodynamic surface in the cavity 102 below the top surface 108 of the club head.

Figure 29:
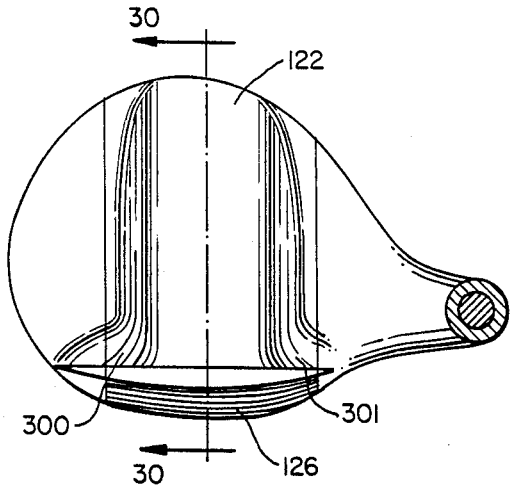
FIG. 29 is a top view of the eighth embodiment of the invention illustrated in FIG. 11.
Figure 30:
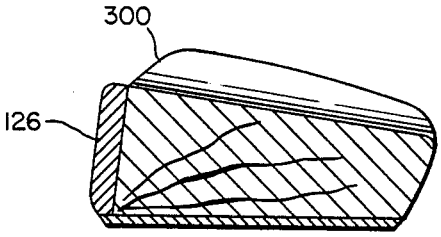
FIG. 30 is a side sectional view of the eighth embodiment of the invention taken along lines 30—30 of FIG. 29.

FIGS. 11, 29 and 30 show an eighth embodiment of the club head 120 of the present invention. A cavity 122 is formed in the top of the club head. The cross sectional configuration of the cavity 122 is rounded which presents an aerodynamically smooth surface for air passing through the channel as the club head 120 is swung. This embodiment also includes a ledge 124 directly behind the ball striking face 126 and below the top surface 128 of the club head 120. The ledge 124 reduces the surface of the ball striking face 126 to permit the high velocity air to enter the cavity at the very beginning or intake region. This permits the channel to duct a greater volume of air more quickly for optimum performance of the invention. In addition, the front vertical edges 300 and 301 of the cavity are rounded in both the vertical and horizontal plane to increase the ducting of air more quickly and efficiently. The forming of a ledge 124 in the club head also reduces the surface of the ball striking face 126 and thereby serves to increase the effectiveness of energy transfer from the club face to the ball. As is shown in FIG. 30, more air can flow directly into the cavity, rather than over the club head face and down into the channel, minimizing air leakage and increasing the air channeling effect.

Figure 13:
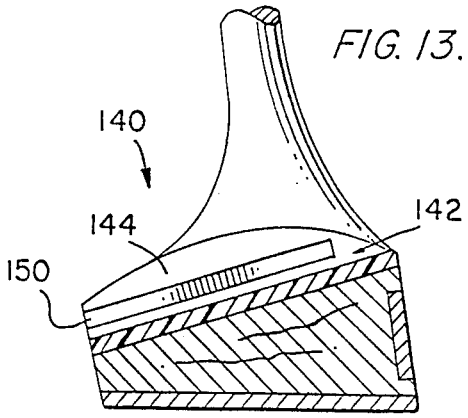
FIG. 13 is a sectional view taken along lines 13—13 of FIG. 12.

FIGS. 12 and 13 illustrate a ninth embodiment of the club head 140 of the present invention. A cavity 142, formed of essentially vertical and parallel walls 144 and 146, is located perpendicular to the club striking face in the same manner as the club head described hereinabove. In this embodiment, the entrance 148 to the cavity 142 is flared slightly for the purpose of providing an aerodynamically smooth surface so that more intake air is ducted into the cavity 142. Also in this embodiment, the cavity is also provided with undercuts 150 formed in both side walls 144 and 146 which act to further stabilize the club head as it is swung. It is believed that these cuts will also further channel and accelerate the air flow, further reducing drag.

Figure 14:
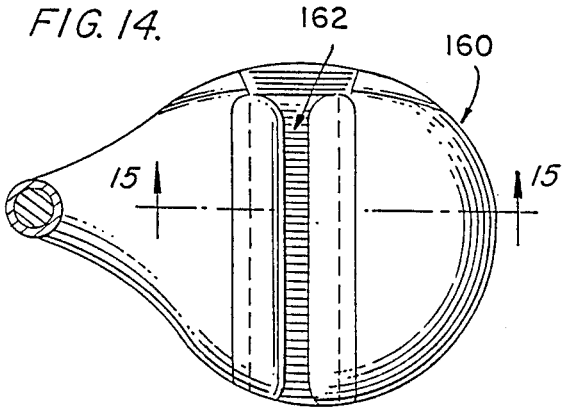
FIG. 14 is a top view of a tenth embodiment of the club head of the present invention.
Figure 15:
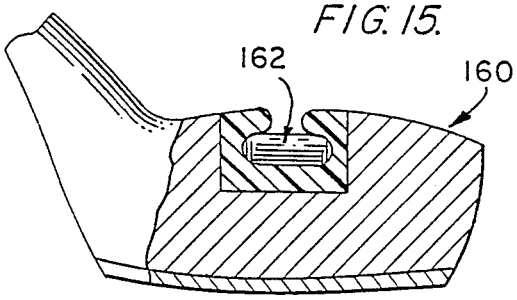
FIG. 15 is a sectional view of the club head taken along lines 15—15 of FIG. 14.

FIGS. 14 and 15 illustrate a tenth embodiment of the present invention. A club head 160 is provided with a cavity 162 having a generally oval cross section, as shown in FIG. 15.

Figure 16:
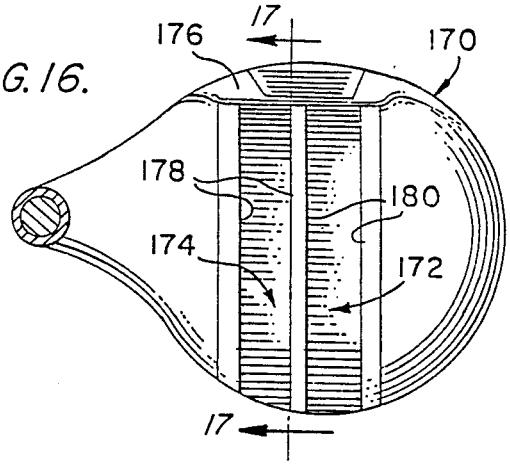
FIG. 16 is a top view of an eleventh embodiment of the club head of the present invention.
Figure 17:
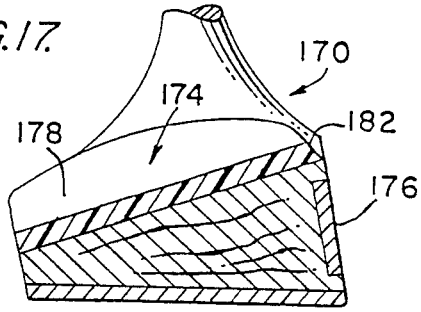
FIG. 17 is a sectional view of the club head taken along lines 17—17 of FIG. 16.
Figure 20:
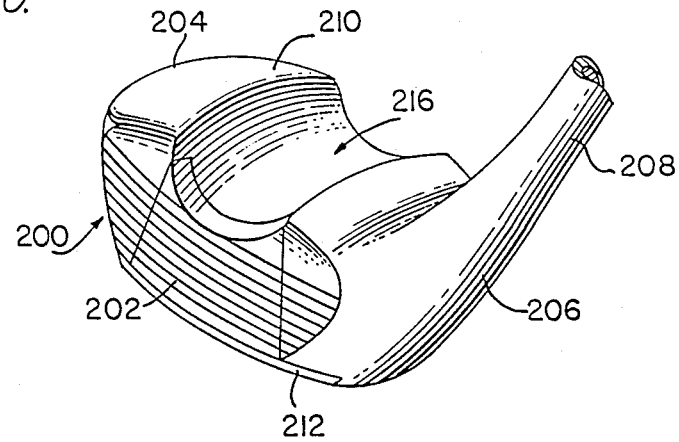
FIG. 20 is a perspective view of a thirteenth embodiment of the club head of the present invention.
Figure 21:
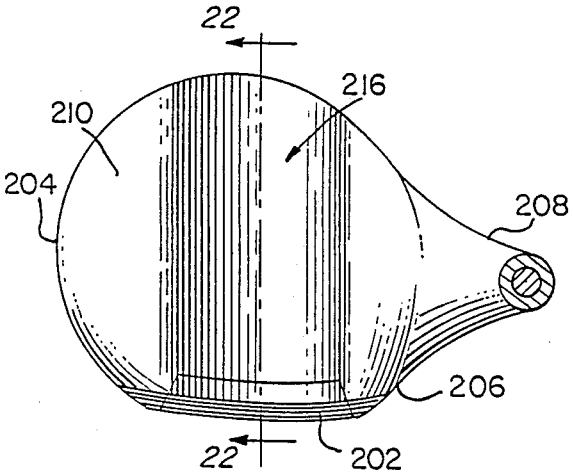
FIG. 21 is a top plan view of the club head of FIG. 20.
Figure 22:
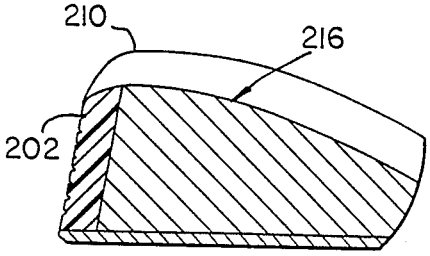
FIG. 22 is a sectional view of the club head of FIG. 21 taken along lines 22—22 of FIG. 21.
Figure 23:
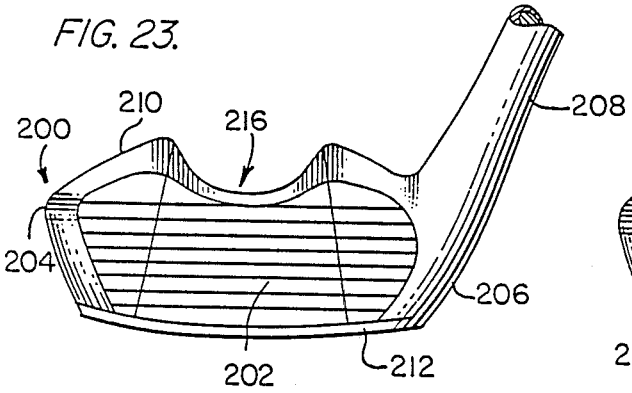
FIG. 23 is a front elevational view of the club head of FIG. 20.

FIGS. 16 and 17 show an eleventh embodiment of the present invention. A club head 170 is provided with two channel-shaped cavities 172 and 174, both formed perpendicular to the striking face 176 of the club head 170 and having parallel, vertical walls 178 and 180. The club head 170 is provided with a sloped surface 182 at the top of the ball striking face 176 to minimize air turbulence and permit a smooth transition of laminar air flow into the cavities 172 and 174. Because of the sloped surface 182, the cavities 172 and 174 begin at a point slightly behind the ball striking face 176.

Figure 18:
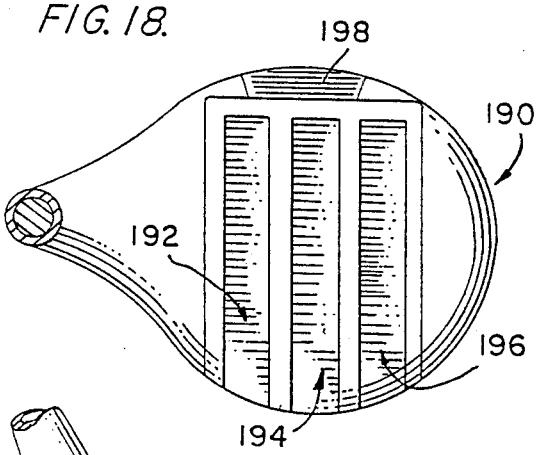
FIG. 18 is a top view of a twelfth embodiment of the club head of the present invention.
Figure 19:
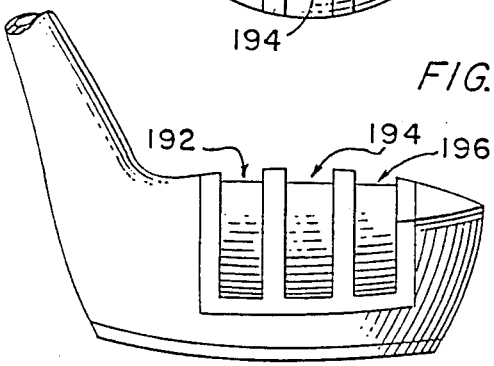
FIG. 19 is a rear elevational view of the club head of FIG. 18.

FIGS. 18 and 19 show a twelfth embodiment of the club head 190 of the present invention. In this embodiment, three channel-shaped cavities 192, 194 and 196 are provided which are generally perpendicular to the ball striking face 198 of the club head 190 and are formed with parallel vertical walls.

FIGS. 20, 21, 22 and 23 illustrate perspective, plan, side sectional and front views of a thirteenth embodiment of a club head 200 of the present invention. The club head is conventional in overall design and includes a ball striking face 202, a toe 204, a heel 206, a hosel 208, a top surface 210 and a bottom surface 212 including a sole plate. The club head is designed to be secured to a shaft with a grip (not shown) to form a golf club used for playing the game of golf. The top of the club head is made with a deep cavity 216 having a radiused cross sectional configuration. In this embodiment, the width of the cavity extends approximately $\frac{3}{8}$ of the total club head width from the toe to the heel, or approximately $1\text{-}\frac{1}{2}$ inches wide on a standard driver-type golf club head which measures 4 inches from the heel 206 to the toe 204. The depth of the cavity is greater than $\frac{1}{4}$ inch below the top surface 210. More preferably, the depth is approximately $\frac{1}{2}$ inch. The aspect ratio in this particular design is 5.8 at the deepest low point of the cavity. The average transverse gradient is greater than 10°. As seen from the drawings, the cavity begins at the club face 202 and extends generally perpendicular thereto toward the rear of the club head.

The exact dimension of the cavity may vary with each particular club head design. Preferably the depth is at least $\frac{1}{4}$ inch along the majority of the cavity's length and along the entire middle portion of the cavity. It will be appreciated that the greater the proportionate width and depth of the cavity to the overall size of the club head, the greater its effectiveness to reduce drag as the club head is swung. Using a cavity with lesser depths and widths will produce corresponding lesser reductions in drag as the club head is swung. Limitations on the size of the cavity would be governed by the resulting strength and integrity of the club head, as well as by the asthetic design of the club head.

Figure 24:
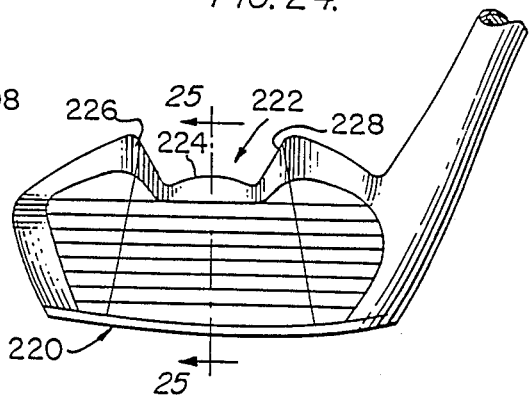
FIG. 24 is a front elevational view of a fourteenth embodiment of the golf club head of the present invention.
Figure 25:
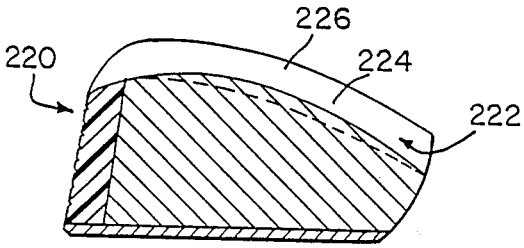
FIG. 25 is a side sectional view of FIG. 24 taken along lines 25—25.

FIGS. 24 and 25 illustrate a fourteenth embodiment of a golf club head 220 of the present invention. The overall shape of the golf club head is essentially the same as the golf club shown in FIGS. 20, 21, 23 and 23 except in the aerodynamic configuration of the cavity 222. In this embodiment, the cavity 222 is provided with a raised aerodynamic air foil shpae 224 which is higher at the midpoint of the bottom of the cavity 222. This arrangement further directs the air flow toward the radiused side walls 226 and 228 which form the cavity 222.

Figure 27:
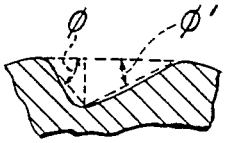
FIG. 27 is a second partial cross sectional view of a golf club head of the present invention, when asymmetrical.
Figure 28:
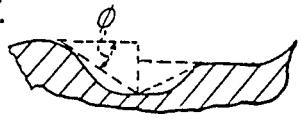
FIG. 28 is a third partial cross sectional view of a club head of the present invention, when asymmetrical.

FIGS. 26, 27 and 28 show partial sectional views of the cavity cross section of the club head. The cavity cross sectional shape may be symmetric or assymmetric. When symmetric, the highest peak of the club head on each side of the cavity will be substantially equal in height and have substantially equal transverse gradients angles on each side of a bottom low point of the cavity. When asymmetric, the cavity cross sectional shape may have: (1) both highest peaks on each edge of the cavity of equal height but the transverse gradients from the bottom low point or the deepest point of the cavity are not equal; (2) substantially equal transverse gradients from the bottom low point of the cavity, but the highest peaks on each edge of the cavity are not of equal height; and (3) any combination of (1) and (2) above. For example, FIG. 26 shows a symmetrical cavity with the bottom low point in the center, and the transverse gradient angles $\phi$ on each side are equal. FIG. 27 shows an asymmetrical cavity shape in a club head where the bottom low point is located to one side of the cavity, and the transverse gradients angles are not equal. The top edges of the cavity are equal. FIG. 28 shows an asymmetrical cavity shape where the bottom low point is the center, but the highest peaks on the edges of the cavity are not of equal height. Notwithstanding the various shapes contemplated by FIGS. 27 and 28, the aspect ratio as well as at least one transverse gradient angle will fall within the limits of less than 20 aspect ratio and more than 3 degree transverse gradient angle, as defined above.

Some embodiments are shown with cavities in the top of the club head formed out of a metal, plastic or the like insert, whereas some embodiments are shown with the channel-shaped cavity formed directly into the wood or metal surfaces. Either arrangement is suitable, depending upon the particular club head material, without departing from the scope of the present invention.

Various channel configurations and other aerodynamic surfaces shown in this application are interchangeable without departing from the scope of the present invention. It is intended that the specification and examples be considered as exemplary only, with a true scope and spirit of the invention being indicated by the following claims:

What is claimed is:

1. A golf club head for a wood-type golf club to be swung at high velocities comprising:

a club head having a ball striking face, a rear face, a heel, a toe, a top surface and a bottom, the ball striking face being made to strike a golf ball and having a height which is at least 50% of the distance between the top surface and the bottom surface of the club head;

aerodynamic means for (1) raising the pressure at the rear of the club head and thus reducing the aerodynamic drag on the club head to provide greater acceleration for increased club head speed for a given force when swinging the club, (2) increasing the aerodynamic lift on the club head to provide a lighter swing feel, and (3) stabilizing the club head during its swing and at impact with the ball to provide improved directional control;

said aerodynamic means including an elongated, deep cavity having side walls and a bottom surface which form an air channel of sufficient depth and width to channel, retain and exhaust a high energy flow of air directly behind the club head;

said cavity being located in the top surface of said club head and extending substantially perpendicular to and rearwardly from said ball striking face to said rear face and forming two elongated top edges at the juncture with said top surface of said club head, said edges providing a stabilizing effect on the flow of air by defining flow lines independent of club head speed; and said cavity having a depth of at least $\frac{1}{4}$ inch and a width of at least $\frac{1}{2}$ inch along a substantial portion of the cavity;

whereby the flow of high energy air through said cavity, when the club head is swung at high velocities, raises the pressure at the rear of the club head and acts as a vertical stabilizer which tends to maintain a square face alignment of the club head.

2. The golf club head of claim 1 wherein the cavity has a depth of at least $\frac{1}{4}$ inch and a width of at least $\frac{1}{2}$ inch along at least a $\frac{1}{2}$ inch long portion of the cavity.

3. The golf club of claim 2 where the cavity has a depth of at least $\frac{1}{4}$ inch and a width of at least $\frac{1}{2}$ inch along the middle portion of said cavity.

4. The golf club head of claim 3 wherein the cavity has an aspect ratio of less than 8 along the middle portion of said cavity.

5. The golf club head of claim 2 wherein the width of the cavity is substantially greater than the cavity's depth.

6. The golf club head of claim 5 further including a sloped surface directly behind said ball striking face and positioned between said ball striking face and said cavity.

7. The golf club head of claim 5 further including a ledge positioned between said ball striking face and said cavity.

8. The golf club head of claim 5 wherein the cross sectional shape of the cavity is rounded.

9. The golf club head of claim 5 wherein said cavity is trapezoidal in shape so the cross sectional exhaust area of the end of the channel proximate said rear face is greater than the cross sectional intake area proximate said ball striking face.

10. The golf club head of claim 5 wherein the inlet end of said cavity is rounded to smooth the transition of air flow into said cavity.

11. The golf club head of claim 2 wherein the cavity has an aspect ratio of less than 20 along at least a $\frac{1}{2}$ inch portion of said cavity.

12. The golf club head of claim 2 wherein the cavity has an aspect ratio of less than 8 along at least a $\frac{1}{2}$ inch portion of said cavity.

13. The golf club head of claim 12 wherein the width of the cavity is substantially greater than the cavity's depth.

14. The golf club head of claim 2 wherein said cavity has a width dimension equal to at least 25% of the total distance between said toe and said heel of said club head and a depth dimension equal to at least 25% of the distance between said top surface and said bottom of said club head.

15. The golf club head of claim 2 wherein said cavity has a symmetrical configuration along its length.

16. The golf club head of claim 2 wherein said cavity has a width dimension equal to at least 12% of the total distance between said toe and said heel and a depth dimension equal to at least 12% of the distance between said top surface and said bottom of said club head.

17. The golf club head of claim 2 wherein said cavity has a depth dimension of at least ⅜ inch along a substantial portion of said cavity.

18. The golf club head of claim 2 wherein the cavity has a depth dimension of at least ½ inch along a substantial portion of said cavity.

19. The golf club head of claim 2 wherein said cavity has a width of at least one inch.

20. The golf club head of claim 2 wherein said cavity has a single symmetrical cross sectional configuration along its entire length, the depth of said cavity is maximum at its longitudinal center, and the cavity has a width of between one inch and two inches.

21. The golf club head of claim 2 wherein said cavity slopes from said ball striking face toward said rear face creating a progressively deeper cavity toward said rear face.

22. The golf club head of claim 2 wherein said cavity further includes longitudinal grooves undercut in said side walls of said cavity.

23. The golf club head of claim 1 wherein the cavity has a depth of at least ¼ inch and a width of at least ½ inch along at least a 1 inch long portion of the cavity.

24. The golf club head of claim 23 wherein the cavity has an aspect ratio of less than 8 along at least a 1 inch portion of said cavity.

25. The golf club head of claim 1 wherein the cavity has a depth of at least ¼ inch and a width of at least ½ inch along substantially its entire length.

26. The golf club head of claim 1 wherein the cavity has an aspect ratio of less than 20 along a substantial portion of said cavity.

27. The golf club head of claim 1 wherein the cavity has an aspect ratio of less than 8 along a substantial portion of said cavity.

28. The golf club head of claim 3 where the surface of said ledge is aligned with the bottom of said cavity.

29. The golf club head of claim 1 wherein the cavity has a transverse gradient angle of more than 3 degrees along a substantial portion of said cavity.

30. The golf club head of claim 1 wherein the cavity has a transverse gradient angle of more than 10 degrees along a substantial portion of said cavity.

31. The golf club is claim 1 wherein the cavity has an aspect ratio of less than 3 along the middle portion of said cavity.

32. The golf club head of claim 1 wherein the depth of said cavity progressively increases from the front of said cavity to the rear of said cavity.

33. The golf club head of claim 1 wherein said cavity has a symmetrical cross sectional configuration along its length and the depth of said cavity is maximum along its longitudinal center.

34. The golf club head of claim 1 wherein said bottom surface of said cavity is planar and said walls of said cavity are perpendicular to said bottom surface.

35. The golf club head of claim 1 wherein said cavity has an asymmetrical configuration along its length.

36. The golf club head of claim 1 wherein said bottom surface of said cavity is planar.

37. The golf club head of claim 1 wherein said bottom surface of said cavity is concave in longitudinal cross section.

38. The golf club head of claim 1 wherein said bottom surface of said cavity is convex in longitudinal cross section.

39. The golf club head of claim 1 wherein said cavity is flared outwardly toward said rear face.

40. The golf club head of claim 1 wherein said cavity includes a flared opening adjacent said ball striking face.

41. The golf club head of claim 1 having a plurality of cavities.

42. The golf club head of claim 41 wherein said plurality is two.

43. The golf club head of claim 1 wherein said walls of said cavity are sloped inwardly toward the bottom center of said cavity.

44. The golf club head of claim 1 wherein said walls are sloped outwardly away from the bottom center of said cavity.

45. A golf club head for a wood-type golf club to be swung at high velocities comprising:

a club head having a ball striking face, a rear face, a heel, a toe, a top surface and a bottom, the ball striking face being made to strike a golf ball and having a height which is at least 50% of the distance between the top surface and the bottom surface of the club head;

aerodynamic means for (1) raising the pressure at the rear of the club head and thus reducing the aerodynamic drag on the club head to provide greater acceleration for increased club head speed for a given force when swinging the club, (2) increasing the aerodynamic lift on the club head to provide a lighter swing feel, and (3) stabilizing the club head during its swing and at impact with the ball to provide improved directional control;

said aerodynamic means including an elongated, deep cavity having side walls and a bottom surface which form an air channel of sufficient depth and width to channel, retain and exhaust a high energy flow of air directly behind the club head;

said cavity being located in the top surface of said club head and extending substantially perpendicular to and rearwardly from said ball striking face to said rear face and forming two elongated top edges at the juncture with said top surface of said club head, said edges providing a stabilizing effect on the flow of air by defining flow lines independent of club head speed;

said cavity having a depth of at least ¼ inch and a width of at least ½ inch along a substantial portion of the cavity; and a ledge positioned between said ball striking force and said cavity, the upper surface of said ledge being aligned with the bottom of said cavity to permit air to flow directly into cavity;

whereby the flow of high energy air through said cavity, when the club head is swung at high velocities, raises the pressure at the rear of the club head and acts as a vertical stabilizer which tends to maintain a square face alignment of the club head.

46. The golf club head of claim 45 wherein the cavity has a depth of at least ¼ inch and a width of at least ½ inch along at least a ½ inch long portion.

47. The golf club head of claim 45 wherein the cavity has a depth of at least ¼ inch and a width of at least ½ inch along at least a 1 inch long portion.

48. The golf club head of claim 47 wherein the inlet end of said cavity is rounded to smooth the transaction of air flow into said cavity.

* * * * *